United States Patent [19]

Forsyth

[11] Patent Number: 4,782,867

[45] Date of Patent: Nov. 8, 1988

[54] APPARATUS FOR SPLITTING LOGS

[76] Inventor: Norman W. Forsyth, P.O. Box 148, Oxbow, Saskatchewan, Canada, S0C 2B0

[21] Appl. No.: 141,753

[22] Filed: Jan. 11, 1988

[51] Int. Cl.[4] ..... B27L 7/00

[52] U.S. Cl. ..... 144/193 B; 144/193 R

[58] Field of Search ..... 144/3 K, 193 R, 193 A, 144/193 B, 193 E, 193 K, 366

[56] References Cited

U.S. PATENT DOCUMENTS

| | | | |
|---|---|---|---|
| 1,598,695 | 9/1926 | Anderson | 144/193 R |
| 2,565,406 | 8/1951 | Stennitt | 144/193 R |

FOREIGN PATENT DOCUMENTS

| | | |
|---|---|---|
| 172873 | 10/1916 | Canada . |
| 69985 | 1/1917 | Canada . |
| 441770 | 6/1947 | Canada . |
| 449435 | 6/1948 | Canada . |
| 1063489 | 10/1979 | Canada . |
| 1084814 | 9/1980 | Canada . |
| 1142065 | 3/1983 | Canada . |

*Primary Examiner*—W. Donald Bray

*Attorney, Agent, or Firm*—Beveridge, DeGrandi & Weilacher

[57] ABSTRACT

Apparatus for splitting logs comprises a base frame carrying a splitting wedge which has an upwardly facing blade edge, and which is associated with means for supporting a log with its lower end resting on the blade edge. A post projects upwardly from the base at a point spaced away from the wedge and carries pivot means for a beam. The beam has a hammer weight adjacent one end which is arranged to strike the upper end of the log supported on the wedge. Means are provided limiting downward movement of the beam to prevent the hammer weight from striking the wedge. The apparatus is operated manually by raising the hammer and letting this fall onto the top end of the log.

6 Claims, 1 Drawing Sheet

APPARATUS FOR SPLITTING LOGS

The present invention relates to a manually operated device for splitting logs.

Various log splitting devices have been designed in the past, both manually operated and motor driven. Manually operated devices often employ a hydraulic ram to provide the splitting force; however, such devices are relatively expensive and slow acting.

Usually, log splitting devices have a moveable wedge which acts against the end of a log held on a support. In such devices, it may be difficult to ensure that the wedge acts on the leg at the most desirable location.

The present invention provides a device which is inexpensive and which is relatively fast in operation although not employing any motor drive. The device allows a wedge blade to be positioned carefully relative to the log end and also maintains this location during multiple strikes of the wedge.

In accordance with the present invention, apparatus for splitting log comprises:

a base frame, a splitting wedge fixed to the base frame and having an upwardly facing blade edge, means for supporting a log with its lower end resting on said blade edge, a post projecting upwardly from said base frame at a point spaced away from the wedge and carrying pivot means above the level of the blade edge, a beam pivotally mounted on said pivot means and having, adjacent one end, a hammer weight arranged to stike the upper end of the log supported by the supporting means, and means limiting downward movement of the beam to prevent the hammer weight from striking the wedge.

Figure 1:
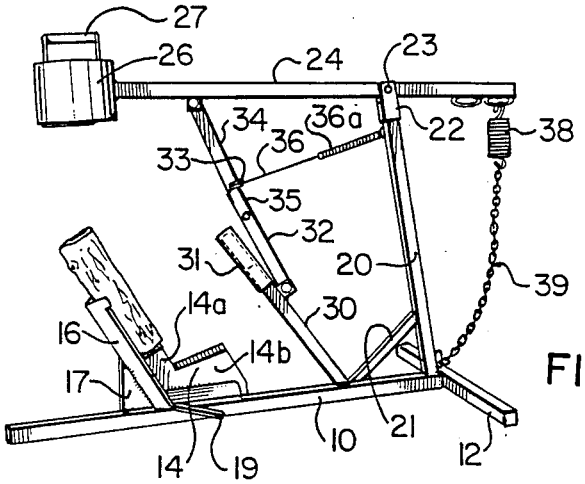
Figure 2:
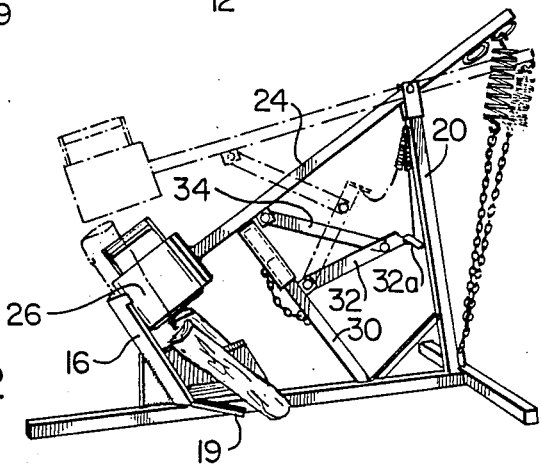
Figure 3:
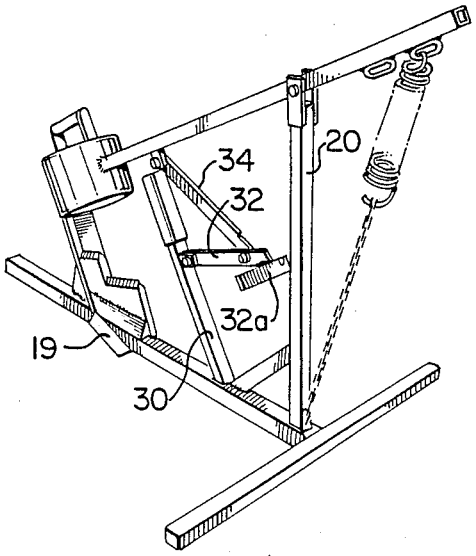

The invention will be described in more detail with reference to the accompanying drawings, showing a preferred embodiment, and in which:

FIG. 1 shows a perspective view of the log splitting apparatus with a log ready to be split, FIG. 2 shows a similar view of the apparatus after the log has been split, FIG. 3 shows a further perspective view of the apparatus in the same condition as shown in FIG. 2.

As shown in the drawings, the device has a base frame formed by a longitudinal bar 10 joined at a rear end to a lateral bar 12 in a T shaped arrangement. The bar 10 has a wedge 14 securely welded thereto by gussets, and projecting upwardly from bar 10 in a vertical plane. The wedge has its rear end located about half way along the bar 10. The wedge has a step arrangement of two vertically aligned blade edges, namely an upper blade edge **14*a* and a lower blade edge 14*b*, the upper blade edge being about one half of the length of the lower blade edge and being positioned in front of the lower blade edge. The blade edges are perpendicular to a front edge of the blade which slopes forwardly at an angle of about 65 degrees to the bar 10. This front edge of the wedge is welded to the bottom of a V shaped channel formed by angle member 16 also having its lower end welded to bar 10 and sloping upwardly at about 65 degrees to the bar 10, being braced thereto by a gusset 17. This channel 16 projects above the top of the upper blade edge by an amount of say 8 inches, so that a log can be located as shown in FIG. 1 with its bottom edge resting on the upper blade edge and with the channel acting as a support. Below the wedge 14, the bar 10 is provided with outwardly rearwardly sloping wing pieces 19** which assist in separating the lower ends of a split log.

A post 20 projects upwardly from beam 10 near its rearward end, and is braced by member 21. Post 20 carries small plates 22 which in turn carry a pivot 23 for a rocking beam 24. Beam 24 has, at its front end, a hammer weight 26 securely welded thereto, in a position to strike the end of a log held by the support channel 16 but without hitting the support. The hammer weight is formed of a cylinder of say 8" diameter with a closed lower end, formed by a substantial welded plate, the cylinder containing a lead weight so that the total weight of the hammer weight is about 80 lbs. The top of the weight has a handle 27.

A secondary post 30 is provided projecting upwardly from the base 10, between the wedge and post 20, at an angle roughly parallel to that of the support 16. The top of this post carries a cap 31, which is positioned to act as a stop for the beam 24 to prevent the hammer weight from striking the wedge. All of bars 10, 12, 20, 24, and 30 are formed of square sectioned steel tubing.

Post 30 and beam 24 are connected by a pair of links 32, 34 which are pivotally connected together at 35 and are each pivoted to brackets on the respective post 30 and beam 24. The link 32 has an offset, sidewardly projecting handle member **32*a* which contacts the edge of link 34 when the links are moved to a slightly over centre position which is shown in FIG. 1. This handle part 32*a* is connected to a point near the top of post 20 by a tension member 36 and tension spring 36*a*. The arrangement is such that with the parts in the over centre position of FIG. 1 the hammer weight holds the links in this position against the tension of spring 36*a* but the spring 36*a*** pulls the links out of this position as soon as the hammer weight is lifted slightly.

A further spring 38 is mounted on a rear end of beam 24, which projects beyond the pivot means 22, and this spring is connected by a chain 39 to the bottom of post 20. This spring serves to cushion slightly the fall of the hammer weight as beam 24 approaches the stop part 31.

In operation, the hammer weight can be lifted by its handle 27, and handle 32a can be manipulated to move the links 32 and 34 to the over centre position in which the parts remain when the hammer weight is allowed to rest. In this position, both hands of an operator are free to place a log on the wedge, as shown in FIG. 1. Slight lifting of the hammer weight allows spring **36*a* to pull the links from the over centre postion, and the handle can then be released to allow the hammer weight to fall onto the log. In the final stages of movement, the spring 38 is tensioned to cushion the fall and cap 31 acts as a stop to prevent the hammer weight from striking the wedge. If necessary, the hammer weight can be manually lifted to give repeated blows, without the links being moved to the over centre position. Also, if small logs are being split then an operator can lift the hammer weight with one hand while positioning the log with the other, in which case the links 32 and 34** are not used.

I claim:

1. Apparatus for splitting logs comprising:

a base frame, a splitting wedge fixed to said base frame and having an upwardly facing blade edge, means for supporting a log with its lower end resting on said blade edge, a post projecting upwardly from said base frame at a point spaced away from said wedge and carrying pivot means spaced above the level of said blade edge, a beam pivotally mounted on said pivot means and having, adjacent one end, a hammer weight arranged to strike the upper end of a log supported by said supporting means, and means limiting downward movement of the beam to prevent the hammer weight from striking the wedge.

2. Apparatus according to claim 1, wherein the hammer weight is provided with a handle for raising it.

3. Apparatus according to claim 1, wherein there is provided a pair of links between the frame and the beam and arranged to hold the beam in the raised position when the links are moved to an over centre condition.

4. Apparatus according to claim 1, wherein said means limiting downward movement of the beam is a second post projecting upwardly from the base frame and having its upper end located so as to interfere with downward movement of the part of said beam carrying the hammer weight.

5. Apparatus according to claim 1, wherein a tension spring is connected between the frame and an extension of the beam on the side of said pivot means remote from the hammer weight.

6. Apparatus according to claim 1, wherein said wedge has two blade edges which are vertically aligned but displaced from each other in a step arrangement.

* * * * *